US010712076B2

(12) United States Patent
Luo

(10) Patent No.: US 10,712,076 B2
(45) Date of Patent: Jul. 14, 2020

(54) AIR-COOLED REFRIGERATOR

(71) Applicants: HEFEI HUALING CO., LTD., Hefei (CN); HEFEI MIDEA REFRIGERATOR CO., LTD., Hefei (CN)

(72) Inventor: Yang Luo, Hefei (CN)

(73) Assignees: HEFEI HUALING CO., LTD, Hefei (CN); HEFEI MIDEA REFRIGERATOR CO., LTD., Hefei (CN)

( * ) Notice: Subject to any disclaimer, the term of this patent is extended or adjusted under 35 U.S.C. 154(b) by 617 days.

(21) Appl. No.: 15/317,647

(22) PCT Filed: Jan. 15, 2015

(86) PCT No.: PCT/CN2015/070745
§ 371 (c)(1),
(2) Date: Dec. 9, 2016

(87) PCT Pub. No.: WO2015/188623
PCT Pub. Date: Dec. 17, 2015

(65) Prior Publication Data

US 2017/0108264 A1 Apr. 20, 2017

(30) Foreign Application Priority Data

Jun. 11, 2014 (CN) ..... 2014 1 0258755

(51) Int. Cl.
*F25D 17/06* (2006.01)
*F25D 17/04* (2006.01)
*F25D 17/08* (2006.01)

(52) U.S. Cl.
CPC ..... *F25D 17/065* (2013.01); *F25D 17/045* (2013.01); *F25D 17/08* (2013.01);
(Continued)

(58) Field of Classification Search
CPC ..... F25D 17/065; F25D 17/08; F25D 17/062; F25D 17/045; F25D 17/06;
(Continued)

(56) References Cited

U.S. PATENT DOCUMENTS 3,261,173 A * 7/1966 Gould ..... F25D 21/14 62/156
3,411,312 A * 11/1968 Sigl ..... F25D 17/065 62/180
(Continued)

FOREIGN PATENT DOCUMENTS

CN 101571337 A 11/2009
CN 103673463 A 3/2014
(Continued)

OTHER PUBLICATIONS

ISA/CN, International Search Report for PCT/CN2015/070745 dated Apr. 14, 2015.
(Continued)

*Primary Examiner* — Jianying C Atkisson
*Assistant Examiner* — Miguel A Diaz
(74) *Attorney, Agent, or Firm* — Seed IP Law Group LLP

(57) ABSTRACT

A air-cooled refrigerator is provided, comprising: a freezer compartment (103), a refrigeration compartment (104), a temperature changeable compartment (105), a finned evaporator (106), an electric air door (107), an air inlet duct (101) and an air return duct (102), wherein the main air duct (1011) has one end connected to the refrigeration compartment air inlet duct (1012) and the temperature changeable compartment air inlet duct (1013) respectively, and the other end connected to an outlet of the finned evaporator (106), and in the air return duct (102), both the refrigeration compartment air return duct (1021) and the temperature changeable compartment air return duct (1022) introduce the returning air
(Continued)

into the bottom of the finned evaporator (106), the electric air door (106) is communicated with the refrigeration compartment air inlet duct (1012) and the temperature changeable compartment air inlet duct (1013) respectively.

22 Claims, 9 Drawing Sheets

(52) U.S. Cl.
CPC ..... *F25D 2317/0671* (2013.01); *F25D 2317/0672* (2013.01); *F25D 2500/02* (2013.01)

(58) Field of Classification Search
CPC ..... F25D 2317/063; F25D 2317/061; F25D 2317/065; F25D 2317/066; F25D 2317/067; F25D 2317/0671; F25D 2317/0672
See application file for complete search history.

(56) References Cited

U.S. PATENT DOCUMENTS

| | | | | | |
|---|---|---|---|---|---|
| 4,326,385 | A * | 4/1982 | Ibrahim | F25D 21/125 | 62/256 |
| 5,819,552 | A * | 10/1998 | Lee | F25D 17/065 | 62/407 |
| 5,943,870 | A * | 8/1999 | Lee | F25D 17/045 | 62/187 |
| 6,397,609 | B1 * | 6/2002 | Shikata | B60H 1/00514 | 361/701 |
| 2006/0152125 | A1 * | 7/2006 | Anderson | F25D 23/065 | 312/406.2 |
| 2007/0295706 | A1 * | 12/2007 | Brun | B60H 1/2225 | 219/202 |
| 2010/0300137 | A1 * | 12/2010 | Lim | F25D 17/065 | 62/419 |
| 2012/0011879 | A1 * | 1/2012 | Gu | F25D 17/065 | 62/408 |
| 2013/0000333 | A1 * | 1/2013 | Kim | F25D 17/065 | 62/129 |
| 2013/0014930 | A1 * | 1/2013 | O'Brien | F25D 1/00 | 165/287 |
| 2017/0115048 | A1 * | 4/2017 | Zardo | F25D 11/02 | |
| 2018/0016018 | A1 * | 1/2018 | Burd | B64F 5/00 | |
| 2018/0120016 | A1 * | 5/2018 | Maxwell | F25D 17/045 | |
| 2018/0259239 | A1 * | 9/2018 | Kim | F25D 23/069 | |
| 2018/0328641 | A1 * | 11/2018 | Lee | F25D 17/04 | |

FOREIGN PATENT DOCUMENTS

| | | | | | |
|---|---|---|---|---|---|
| CN | 203964509 | U | | 11/2014 | |
| EP | 0419817 | A2 | * | 4/1991 | F25D 17/045 |
| EP | 0419817 | A2 | | 4/1991 | |
| EP | 3301386 | A1 | * | 4/2018 | F25D 11/02 |
| JP | S53157524 | U | | 12/1978 | |
| JP | S54142109 | U | | 10/1979 | |
| JP | S5658076 | | | 5/1981 | |
| JP | H0250064 | A | | 2/1990 | |
| JP | 10311654 | A | * | 11/1998 | |
| JP | H10311654 | A | | 11/1998 | |
| JP | H110300311 | | | 11/1998 | |
| JP | 2000130875 | A | * | 5/2000 | F25D 17/065 |
| JP | 2002098465 | A | | 4/2002 | |
| JP | 2002107040 | A | | 4/2002 | |
| JP | 2006183894 | | | 7/2006 | |
| JP | 2007187362 | | | 7/2007 | |
| JP | 2012042077 | | | 3/2012 | |
| JP | 2013069254 | | | 4/2013 | |
| KR | 20110098413 | | | 9/2011 | |
| WO | 2013069254 | | | 5/2013 | |

OTHER PUBLICATIONS

ISA/CN, Written Opinion of the International Searching Authority for PCT/CN2015/070745 dated Apr. 14, 2015.
European Patent Office, Extended European Search Report for EP15806247.1, dated Jan. 17, 2018.
Japanese Patent Office, Notification of Reasons for Refusal, JP2017-517161, dated Feb. 1, 2018.
KIPO, Office Action for KR Application No. 10-2017-7000614, dated Sep. 3, 2018.
JPO, Office Action for JP Application No. 2017517161, dated Oct. 5, 2018.

* cited by examiner

AIR-COOLED REFRIGERATOR

CROSS-REFERENCE TO RELATED APPLICATION

This application claims priority to and benefits of Chinese Patent Application Serial No. 201410258755.1, filed with the State Intellectual Property Office of P. R. China on Jun. 11, 2014, the entire content of which is incorporated herein by reference.

FIELD

The present disclosure relates to a technical field of household appliance, and more particularly to an air-cooled refrigerator.

BACKGROUND

Currently, refrigerators existing in the markets mainly include two kinds that are direct cooling refrigerators and air-cooled refrigerators according to the refrigerating mode. With the user's growing demands for use and continuous improvements of manufacturing technologies in the refrigerator industry, the air-cooled refrigerator has been well received by the consumers because of its good temperature control ability, no frost in the refrigerator, better preservative effect and the like advantages, and gradually becomes the mainstream product in the market. The refrigerating method thereof is generally that due to the pressure caused by a fan, cold air is sucked out from an evaporator of a freezer compartment and then distributed to each compartment by an air duct device.

The existing air-cooled refrigerators mostly adopts an electric switching valve to switch the refrigerant and can't provide the cold air to each compartment in the air-cooled refrigerator simultaneously, the cooling rate is low. The cold air having passed through the evaporator needs to be discharged by using two or more fans, and the cold air needs to be transferred to each compartment of the air-cooled refrigerator through different air inlet ducts, the overall structure is complicated, the energy consumption of a plurality of fans is great, and the cold air needs to be input into each compartment by an independent air inlet duct, which occupies the limited space of the back of the air-cooled refrigerator, moreover the plurality of independent air inlet ducts will increase the production cost. In addition in the air-cooled refrigerator, an air return duct of a refrigeration compartment and an air return duct of a temperature changeable compartment are mostly in communication, return air in the refrigeration compartment has a large temperature difference and a large humidity difference from return air in the temperature changeable compartment, they are gathered on the evaporator together, easily leading to frost formation on the evaporator and an air duct mouth. If the frost is formed, greater energy consumption will be needed for defrosting, hence the energy consumption of the air-cooled refrigerator is increased. Furthermore, an air inlet control device is not disposed in the refrigeration compartment and the temperature changeable compartment generally, so a volume of air entering the refrigeration compartment and the temperature changeable compartment cannot be controlled accurately, which will reduce the accuracy of temperature control of the air-cooled refrigerator or increase the energy consumption of the air-cooled refrigerator.

SUMMARY

Embodiments of the present disclosure seek to solve at least one of the problems existing in the related art to at least some extent. For that reason, the present disclosure provides an air-cooled refrigerator has a simple structure, easy production and manufacture, low production and manufacture cost, low energy consumption, high cooling rate and accurate temperature control.

The air-cooled refrigerator according to embodiments of the present disclosure includes: a freezer compartment; a refrigeration compartment; a temperature changeable compartment; a finned evaporator; an air inlet duct mounted to a rear wall of a refrigerator body, the air inlet duct includes: a main air duct, a refrigeration compartment air inlet duct and a temperature changeable compartment air inlet duct, the main air duct has a first end connected to the refrigeration compartment air inlet duct and the temperature changeable compartment air inlet duct respectively, and a second end connected to an outlet of the finned evaporator, the finned evaporator provides cold air to the refrigeration compartment and the temperature changeable compartment respectively through the main air duct, the refrigeration compartment air inlet duct and the temperature changeable compartment air inlet duct successively, the finned evaporator further provides the cold air to the freezer compartment; an air return duct mounted to the rear wall of the refrigerator body, the air return duct includes a refrigeration compartment air return duct and a temperature changeable compartment air return duct, the refrigeration compartment air return duct guides return air in the refrigeration compartment into a lower portion of the finned evaporator, the temperature changeable compartment air return duct guides the returning air of the temperature changeable compartment into the lower portion of the finned evaporator, and an outlet of the refrigeration compartment air return duct and an outlet of the temperature changeable compartment air return duct are spaced apart in the lower portion of the finned evaporator; electric air doors disposed in the refrigeration compartment air inlet duct and the temperature changeable compartment air inlet duct respectively, the electric air doors may adjust a volume of air entering the refrigeration compartment and the temperature changeable compartment independently.

In the air-cooled refrigerator according to embodiments of the present disclosure, the air inlet duct in the air-cooled refrigerator may be connected with the refrigeration compartment, the temperature changeable compartment and the outlet of the finned evaporator, and the cold air having passed through the finned evaporator will be conveyed into the refrigeration compartment and the temperature changeable compartment through the refrigeration compartment air inlet duct and the temperature changeable compartment air inlet duct at the same time. The air inlet duct has a simple structure, and compared with an air inlet duct in the prior art, the occupation space is smaller and the production cost is lower, and the electric switching valve is not needed to switch a refrigerant, thereby the cooling rate is higher, the structure is simpler, and the production cost is lower. In addition, the refrigeration compartment air return duct and the temperature changeable compartment air return duct are spaced apart in the lower portion of the finned evaporator, which may effectively prevent the two kinds of return air having a larger temperature and humidity difference from being mixed, so that the finned evaporator, the refrigeration compartment air return duct and the temperature changeable compartment air return duct will not be frosted up, saving the energy consumption for defrosting and enabling the energy consumption of the air-cooled refrigerator to be lower. In addition, the electric air doors may adjust the volume of air entering the refrigeration compartment and the temperature changeable compartment independently, enabling the air-cooled refrigerator to precisely control temperature of the refrigeration compartment and the temperature changeable compartment. Therefore the air-cooled refrigerator has more advantages over the traditional air-cooled refrigerator, being helpful for improving the sales volume of the air-cooled refrigerator.

In addition, the air-cooled refrigerator according to the above-mentioned embodiments of the present disclosure may further have the following additional features:

According to an embodiment of the present disclosure, the finned evaporator is mounted to a lower portion of a rear wall of a refrigeration box, both the refrigeration compartment air return duct and the temperature changeable compartment air return duct are connected to a lower end of a rear wall of the refrigeration box, at the ends of the refrigeration compartment air return duct and the temperature changeable compartment air return duct connected to the rear wall of the refrigeration box, the distance between the refrigeration compartment air return duct and the temperature changeable compartment air return duct is greater than or equal to 10 mm. An upper end of the rear wall of the refrigeration box is provided with a freezer compartment air inlet duct communicated with the freezer compartment, the lower end of the rear wall of the refrigeration box is further provided with a freezer compartment air return duct communicated with the freezer compartment. The second end of the main air duct is communicated with the upper end of the rear wall of the refrigeration box, and a height of the main air duct is greater than a height of the freezer compartment air inlet duct.

According to an embodiment of the present disclosure, the refrigeration compartment air inlet duct and the temperature changeable compartment air inlet duct are provided with a refrigeration compartment air inlet and a temperature changeable compartment air inlet respectively. A rear wall of the refrigeration compartment and a rear wall of the temperature changeable compartment are respectively provided with a refrigeration compartment air duct connecting position and a temperature changeable compartment air duct connecting position fitted with the refrigeration compartment air inlet and the temperature changeable compartment air inlet respectively, the refrigeration compartment air inlet and the temperature changeable compartment air inlet are connected to refrigeration compartment air duct connecting position and the temperature changeable compartment air duct connecting position respectively. Both the refrigeration compartment air duct connecting position and the temperature changeable compartment air duct connecting position are provided with the electric air doors therein.

According to an embodiment of the present disclosure, the refrigeration compartment air return duct has a first end configured to be a refrigeration compartment air return port, and a second end configured to be a first freezer air return port, the refrigeration compartment air return port is connected with the refrigeration compartment, the first freezer air return port is connected with the refrigeration box. The temperature changeable compartment air return duct has a first end configured to be a second freezer air return port, and a second end configured to be a temperature changeable compartment air return port, the second freezer air return port is connected with the refrigeration box, the temperature changeable compartment air return port is connected with the temperature changeable compartment. In which, both the first freezer air return port and the second freezer air return port are connected with the lower end of the rear wall of the refrigeration box, and the distance between the first freezer air return port and the second freezer air return port is 10 mm.

According to an embodiment of the present disclosure, the main air duct is provided with a main air duct air inlet, the upper end of the rear wall of the refrigeration box is provided with a main air duct connecting position connected to the main air duct air inlet, the main air duct connecting position is communicated with the freezer compartment air inlet duct, and the height of the main air duct connecting position is greater than the height of the freezer compartment air inlet duct. The main air duct connecting position is further provided with a fan motor therein, when the fan motor rotates, the cold air cooled by the finned evaporator will be blown into the main air duct, and part of the cold air will be blown into the freezer compartment through the freezer compartment air inlet duct.

According to an embodiment of the present disclosure, a sectional area of the refrigeration compartment air return duct is 1-1.2 times as much as a sectional area of the refrigeration compartment air inlet duct, a sectional area of the temperature changeable compartment air return duct is 1-1.2 times as much as a sectional area of the temperature changeable compartment air inlet duct.

According to an embodiment of the present disclosure, the sectional area of the refrigeration compartment air return duct is 1.2 times as much as the sectional area of the refrigeration compartment air inlet duct, the sectional area of the temperature changeable compartment air return duct is 1.2 times as much as the sectional area of the temperature changeable compartment air inlet duct.

According to an embodiment of the present disclosure, the air inlet duct includes: an air inlet duct upper cover and an air inlet duct lower cover, the air inlet duct upper cover and the air inlet duct lower cover are provided with a snap and a snap position respectively, the air inlet duct upper cover and the air inlet duct lower cover are connected with each other through snap-fit between the snap and the snap position, forming the air inlet duct, and a polypropylene tape is wound around an outer wall face of the air inlet duct. The air inlet duct lower cover is provided with an air duct snap, the rear wall of the refrigerator body is provided with an air duct snap position, the air inlet duct is connected to the rear wall of the refrigerator body through snap-fit between the air duct snap and the air duct snap position on the refrigeration compartment air inlet duct.

According to an embodiment of the present disclosure, the air return duct further includes a fixing plate, the fixing plate is provided with a through hole, the refrigeration compartment air return duct and the temperature changeable compartment air return duct are fixedly connected together through the fixing plate, the rear wall of the refrigerator body is provided with a threaded hole matched with the through hole, and the fixing plate is threadedly connected to the rear wall of the refrigerator body.

According to an embodiment of the present disclosure, both the air inlet duct and the air return duct are made of polypropylene material, and the air inlet duct is adhered to the rear wall of the refrigerator body by an adhesive tape.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

DETAILED DESCRIPTION

Figure 1:
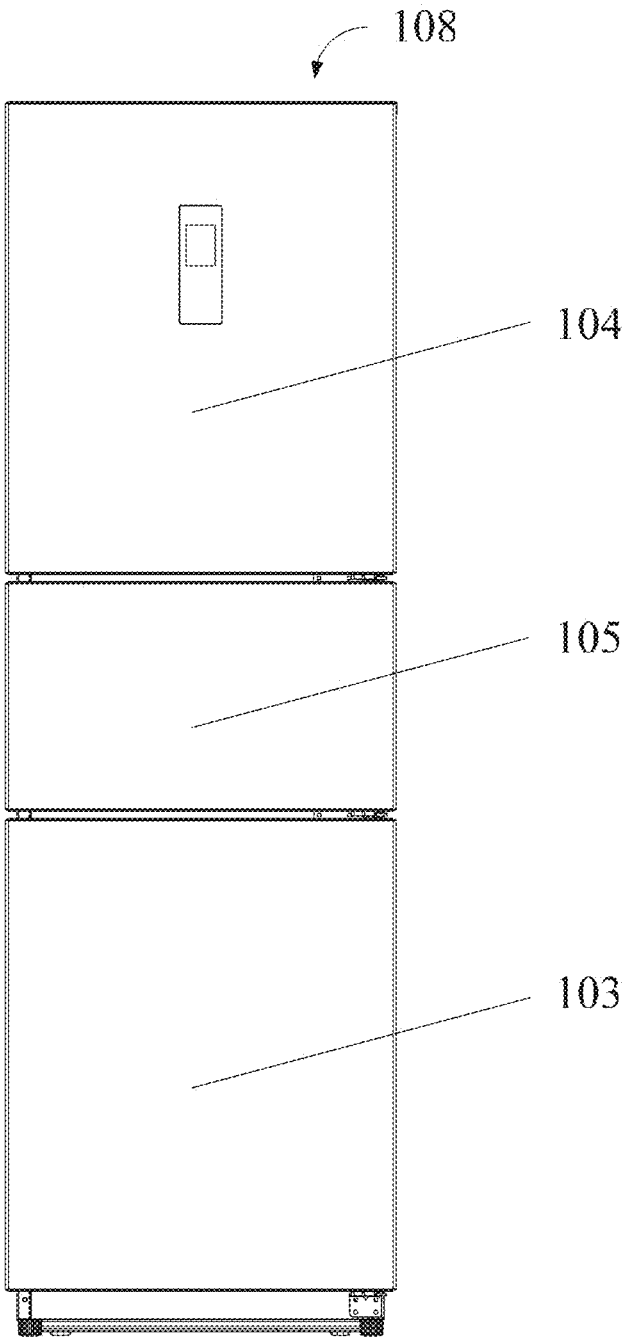
FIG. 1 is a front schematic view of an air-cooled refrigerator according to an embodiment of the present disclosure.
Figure 2:
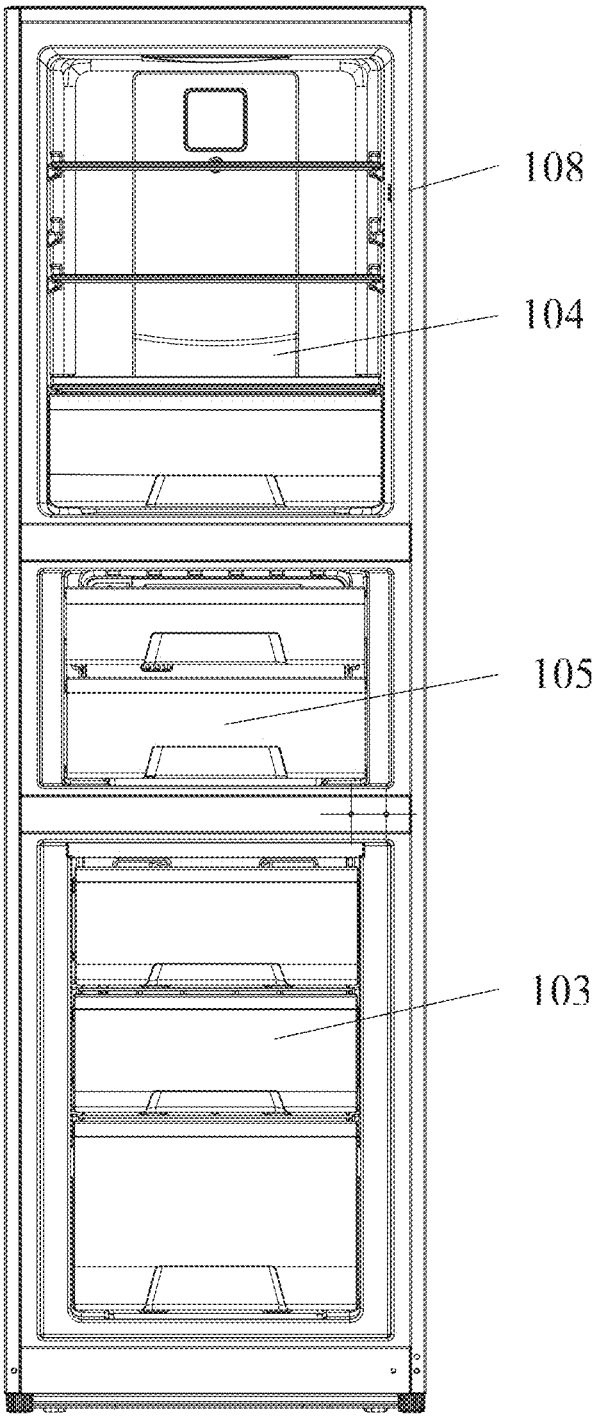
FIG. 2 is a front schematic view of the air-cooled refrigerator shown in FIG. 1, in which a door is removed.

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

A lot of specific details are elaborated in the following descriptions for fully understanding the present disclosure, however the present disclosure may be implemented by further using other ways different from that described herein. Therefore, the protection scope of the present disclosure should not be limited by embodiments disclosed in the following.

Embodiment One

As shown in FIGS. 1-10, an air-cooled refrigerator according to embodiments of the present disclosure includes: an air inlet duct 101 and an air return duct 102, and both the air inlet duct 101 and the air return duct 102 are mounted to a rear wall of a refrigerator body 108. The refrigerator body 108 is provided with a freezer compartment 103, a refrigeration compartment 104 and a temperature changeable compartment 105. The refrigerator body 108 further includes a finned evaporator 106 and an electric air door 107. The air inlet duct 101 includes a main air duct 1011, a refrigeration compartment air inlet duct 1012 and a temperature changeable compartment air inlet duct 1013, the main air duct 1011 has a first end connected to the refrigeration compartment air inlet duct 1012 and the temperature changeable compartment air inlet duct 1013, and a second end connected to an outlet of the finned evaporator 106, the finned evaporator 106 provides cold air to the refrigeration compartment 104 and the temperature changeable compartment 105 through the main air duct 1011, the refrigeration compartment air inlet duct 1012 and the temperature changeable compartment air inlet duct 1013 successively, and the finned evaporator 106 further provides the cold air to the freezer compartment 103. The air return duct 102 includes a refrigeration compartment air return duct 1021 and a temperature changeable compartment air return duct 1022, the refrigeration compartment air return duct 1021 will guide return air in the refrigeration compartment 104 into a lower portion of the finned evaporator 106, the temperature changeable compartment air return duct 1022 will guide return air in the temperature changeable compartment 105 into the lower portion of the finned evaporator 106, and an outlet of the refrigeration compartment air return duct 1021 and an outlet of the temperature changeable compartment air return duct 1022 are spaced apart in the lower portion of the finned evaporator 106. Electric air doors 107 are disposed in the refrigeration compartment air inlet duct 1012 and the temperature changeable compartment air inlet duct 1013 respectively. The electric air doors 107 may adjust a volume of air entering the refrigeration compartment 104 and the temperature changeable compartment 105 independently.

The air inlet duct of the air-cooled refrigerator may be connected to the refrigeration compartment, the temperature changeable compartment and the air outlet of the finned evaporator, and simultaneously conveys the cold air having passed through the finned evaporator into the refrigeration compartment and the temperature changeable compartment through the refrigeration compartment air inlet duct and the temperature changeable compartment air inlet duct. The structure of the air inlet duct is simple, compared with an air inlet duct in the prior art, the occupation space is smaller, the production cost is lower, and an electric switching valve is not needed to switch a refrigerant, the cooling rate is higher, the structure is simpler and the production cost is lower. In addition, the refrigeration compartment air return duct and the temperature changeable compartment air return duct are spaced apart in the lower portion of the finned evaporator, which may effectively prevent the two kinds of return air having a large temperature and humidity difference from being mixed, so that the finned evaporator, the refrigeration compartment air return duct and the temperature changeable compartment air return duct will not be frosted up, saving the energy consumption for defrosting and enabling the energy consumption of the air-cooled refrigerator to be lower. In addition, the electric air doors may adjust the volume of air entering the refrigeration compartment and the temperature changeable compartment independently, enabling the air-cooled refrigerator to precisely control the temperature of the refrigeration compartment and the temperature changeable compartment.

Specifically, as shown in FIGS. 3-6 and FIG. 10, the finned evaporator 106 is mounted to a lower portion of a rear wall of a refrigeration box 1081, both the refrigeration compartment air return duct 1021 and the temperature changeable compartment air return duct 1022 are connected to a lower end of a rear wall of the refrigeration box 1081, at ends of the refrigeration compartment air return duct 1021 and the temperature changeable compartment air return duct 1022 connected to the rear wall of the refrigeration box 1081, a distance between the refrigeration compartment air return duct 1021 and the temperature changeable compartment air return duct 1022 is greater than or equal to 10 mm. An upper end of the rear wall of the refrigeration box 1081 is provided with a freezer compartment air inlet duct 1082 communicated with the freezer compartment 103, the lower end of the rear wall of the refrigeration box 1081 is further provided with a freezer compartment air return duct 1083 communicated with the freezer compartment 103. The second end of the main air duct 1011 is communicated with an upper end of the rear wall of the refrigeration box 1081 and the height of the main air duct 1011 is greater than the height of the freezer compartment air inlet duct 1082.

Both the refrigeration compartment air return duct and the temperature changeable compartment air return duct are connected to the lower end of the rear wall of the refrigeration box, which may effectively prevent the two kinds of return air having a large temperature and humidity difference in the refrigeration compartment and the temperature changeable compartment from being mixed, so that the finned evaporator, the refrigeration compartment air return duct and the temperature changeable compartment air return duct will not be frosted up, saving the energy consumption for defrosting and enabling the energy consumption of the air-cooled refrigerator to be lower. Moreover, the main air duct is communicated with the freezer compartment air inlet duct, so that the cold air having passed through the finned evaporator may be directly conveyed into the refrigeration compartment, the temperature changeable compartment and the freezer compartment through the main air duct and the freezer compartment air inlet duct, thereby the structure is simple and production and manufacturing are is easy.

Specifically, as shown in FIG. 3, FIG. 5, FIG. 6, FIG. 8 and FIG. 9, the refrigeration compartment air inlet duct 1012 and the temperature changeable compartment air inlet duct 1013 are provided with a refrigeration compartment air inlet 10121 and a temperature changeable compartment air inlet 10131 respectively. A rear wall of the refrigeration compartment 104 and a rear wall of the temperature changeable compartment 105 are respectively provided with a refrigeration compartment air duct connecting position 1041 and a temperature changeable compartment air duct connecting position 1051 therein fitted with the refrigeration compartment air inlet 10121 and the temperature changeable compartment air inlet 10131 respectively. The refrigeration compartment air inlet 10121 and the temperature changeable compartment air inlet 10131 may be connected to refrigeration compartment air duct connecting position 1041 and the temperature changeable compartment air duct connecting position 1051 respectively. The electric air doors 107 are disposed in the refrigeration compartment air duct connecting position 1041 and the temperature changeable compartment air duct connecting position 1051 respectively.

The electric air doors are disposed in the refrigeration compartment air duct connecting position and the temperature changeable compartment air duct connecting position, and may adjust the volume of air entering the refrigeration compartment and the temperature changeable compartment independently, enabling the air-cooled refrigerator to precisely control the temperature of the refrigeration compartment and the temperature changeable compartment.

Specifically, as shown in FIG. 3, FIG. 5, FIG. 7 and FIG. 10, the refrigeration compartment air return duct 1021 has a first end configured to be a refrigeration compartment air return port 10211, and a second end configured to be a first freezer air return port 10212, the refrigeration compartment air return port 10211 is connected with the refrigeration compartment 104, and the first freezer air return port 10212 is connected with the refrigeration box 1081. The temperature changeable compartment air return duct 1022 has a first end configured to be a second freezer air return port 10222, and a second end configured to be a temperature changeable compartment air return port 10221, the second freezer air return port 10222 is connected with the refrigeration box 1081, and the temperature changeable compartment air return port 10221 is connected with the temperature changeable compartment 105. In which, both the first freezer air return port 10212 and the second freezer air return port 10222 are connected with the lower end of the rear wall of the refrigeration box 1081, and a distance between the first freezer air return port 10212 and the second freezer air return port 10222 is 10 mm.

Certainly, as shown in FIG. 3, FIG. 5, FIG. 6 and FIG. 10, the main air duct 1011 is provided with a main air duct air inlet 10111, the upper end of the rear wall of the refrigeration box 1081 is provided with a main air duct connecting position 10811 connected to the main air duct air inlet 10111, the main air duct connecting position 10811 is communicated with the freezer compartment air inlet duct 1082, and the height of the main air duct connecting position 10811 is greater than the height of the freezer compartment air inlet duct 1082. The main air duct connecting position 10811 is further provided with a fan motor 10812 therein, when the fan motor 10812 rotates, cold air cooled by the finned evaporator 106 will be blown into the main air duct 1011, and part of the cold air will be blown into the freezer compartment 103 through the freezer compartment air inlet duct 1082.

When the fan motor rotates, the cold air cooled by the finned evaporator will be blown into the main air duct, however under the action of the fan motor, the cold air will pass through the freezer compartment air inlet duct when blown into the main air duct, thereby being blown into the freezer compartment, the overall structure is simple and the freezer compartment will introduce the cold air without disposing a fan motor separately, which may effectively reduce cost and save the energy consumption.

Specifically, as shown in FIGS. 3-10, a sectional area of the refrigeration compartment air return duct 1021 is 1-1.2 times as much as a sectional area of the refrigeration compartment air inlet duct 1012, a sectional area of the temperature changeable compartment air return duct 1022 is 1-1.2 times as much as a temperature changeable compartment air inlet duct 1013.

Preferably, as shown in FIGS. 3-10, the sectional area of the refrigeration compartment air return duct 1021 is 1.2 times as much as the sectional area of the refrigeration compartment air inlet duct 1012, and the sectional area of the temperature changeable compartment air return duct 1022 is 1.2 times as much as the temperature changeable compartment air inlet duct 1013.

When the sectional area of the refrigeration compartment air return duct is 1.2 times as much as the sectional area of the refrigeration compartment air inlet duct and the sectional area of the temperature changeable compartment air return duct is 1.2 times as much as the temperature changeable compartment air inlet duct, a balance between the inlet air and the return air will be reached, improving the circulating efficiency of the cold air, thereby improving the refrigeration efficiency of the air-cooled refrigerator and reducing the energy consumption of the air-cooled refrigerator.

In an embodiment of the present disclosure, as shown in FIGS. 3-6, the air inlet duct 101 includes an air inlet duct upper cover 1014 and an air inlet duct lower cover 1015, the air inlet duct upper cover 1014 and the air inlet duct lower cover 1015 are provided with a snap and a snap position respectively, the air inlet duct upper cover 1014 and the air inlet duct lower cover 1015 are connected with each other through snap-fit between the snap and the snap position, forming the air inlet duct, and a polypropylene tape is wound around an outer wall face of the air inlet duct. The air inlet duct lower cover 1015 is provided with an air duct snap 10151, a rear wall of the refrigerator body 108 is provided with an air duct snap position 1084, the air inlet duct 101 is connected to the rear wall of the refrigerator body 108 through the snap-fit between the air duct snap 10151 on the refrigeration compartment air inlet duct 1012 and the air duct snap position 1084.

A difference from an air duct of the traditional air-cooled refrigerator is that, the air inlet duct is configured to have a snap-fit structure, thus facilitating the production and assembling of the air inlet duct. Moreover, during the process of installing the air inlet duct to the air-cooled refrigerator, no screw is needed for fixation, thereby improving the assembling efficiency. In addition, considering that the polypropylene tape is wound around the outer wall face of the air inlet duct, the polypropylene tape has a low cost and a good sealing effect, and is easy to assemble.

Figure 3:
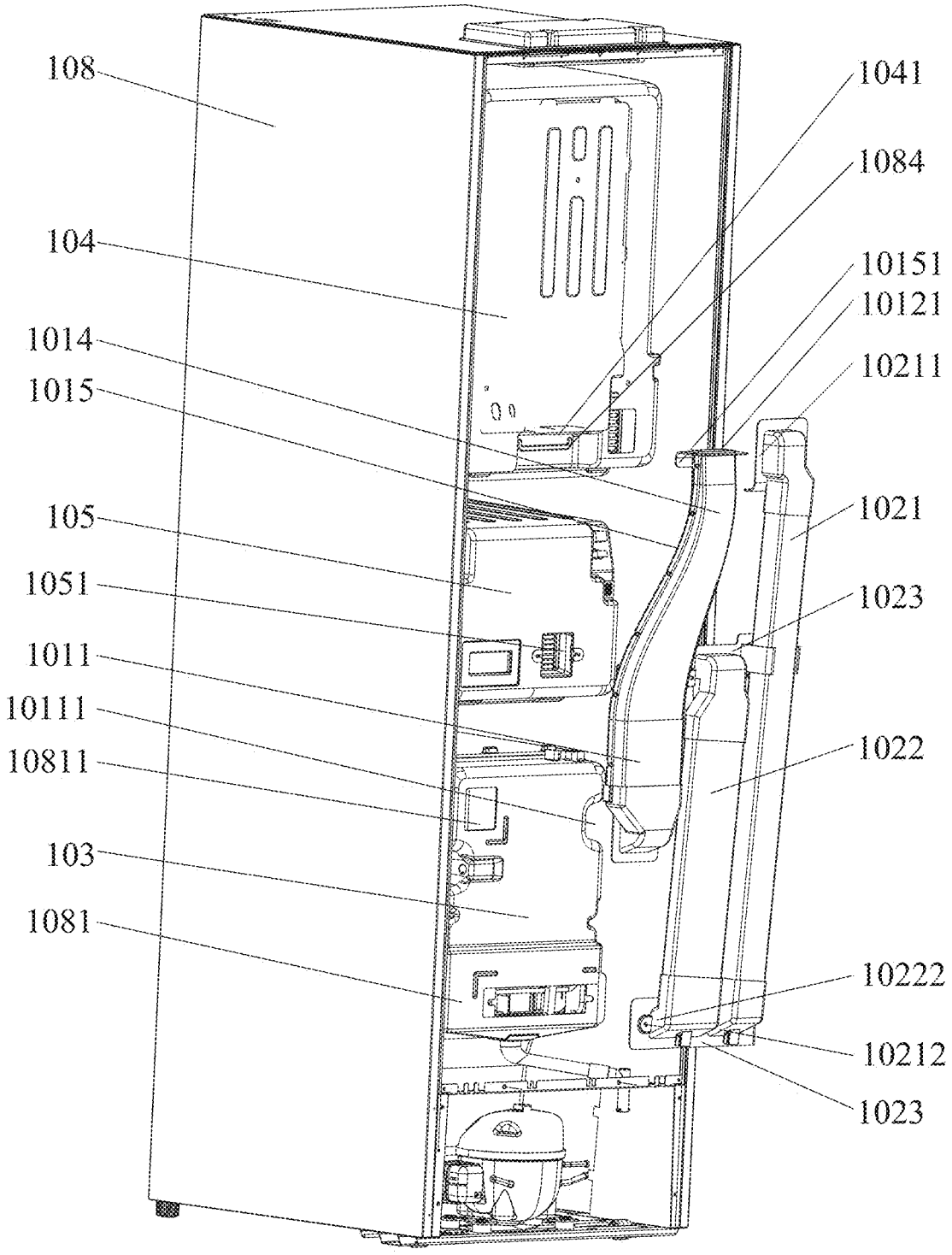
FIG. 3 is an explosive view of a back of the air-cooled refrigerator shown in FIG. 1.
Figure 4:
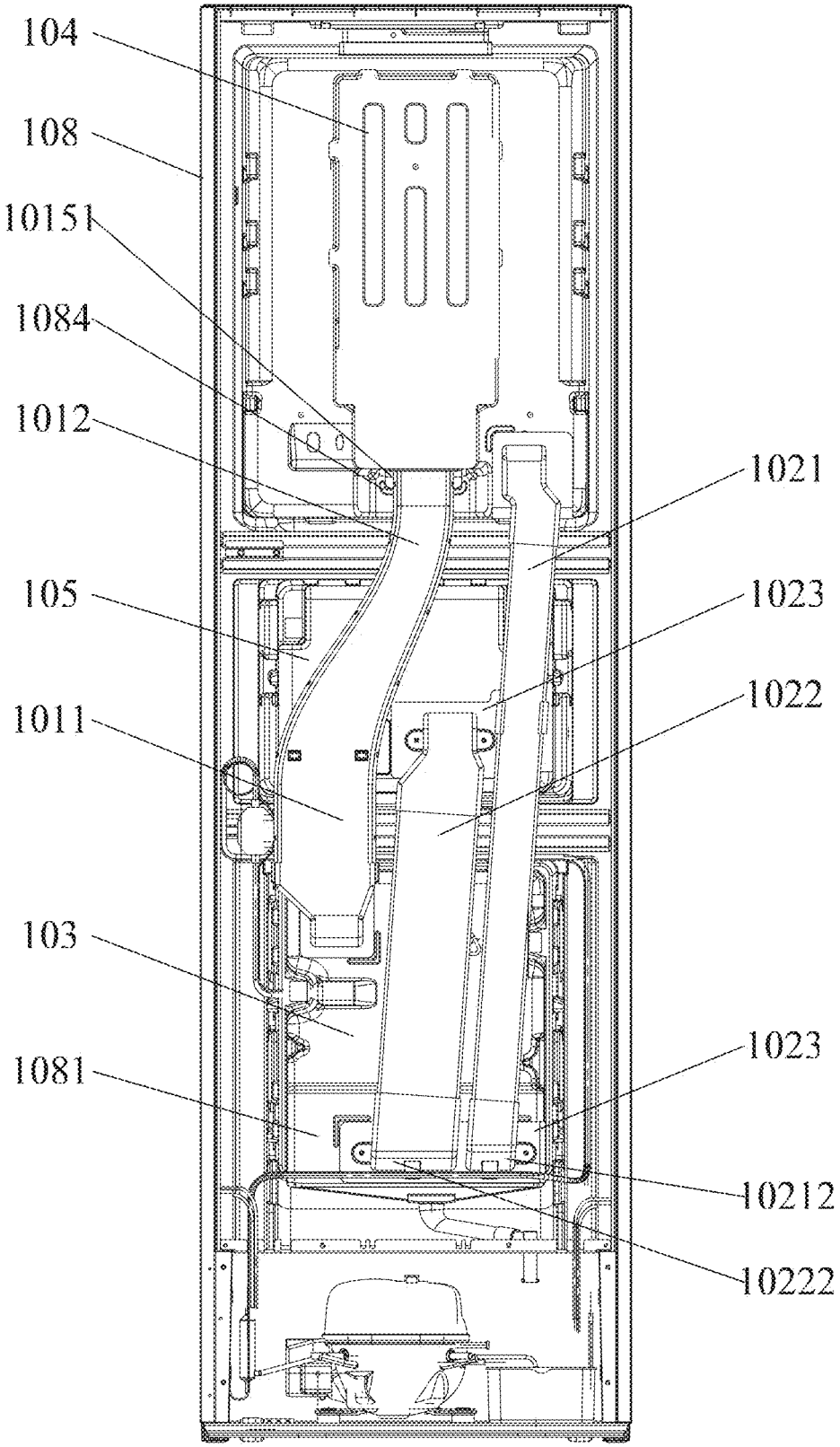
FIG. 4 is a rear schematic view of the air-cooled refrigerator shown in FIG. 1.
Figure 5:
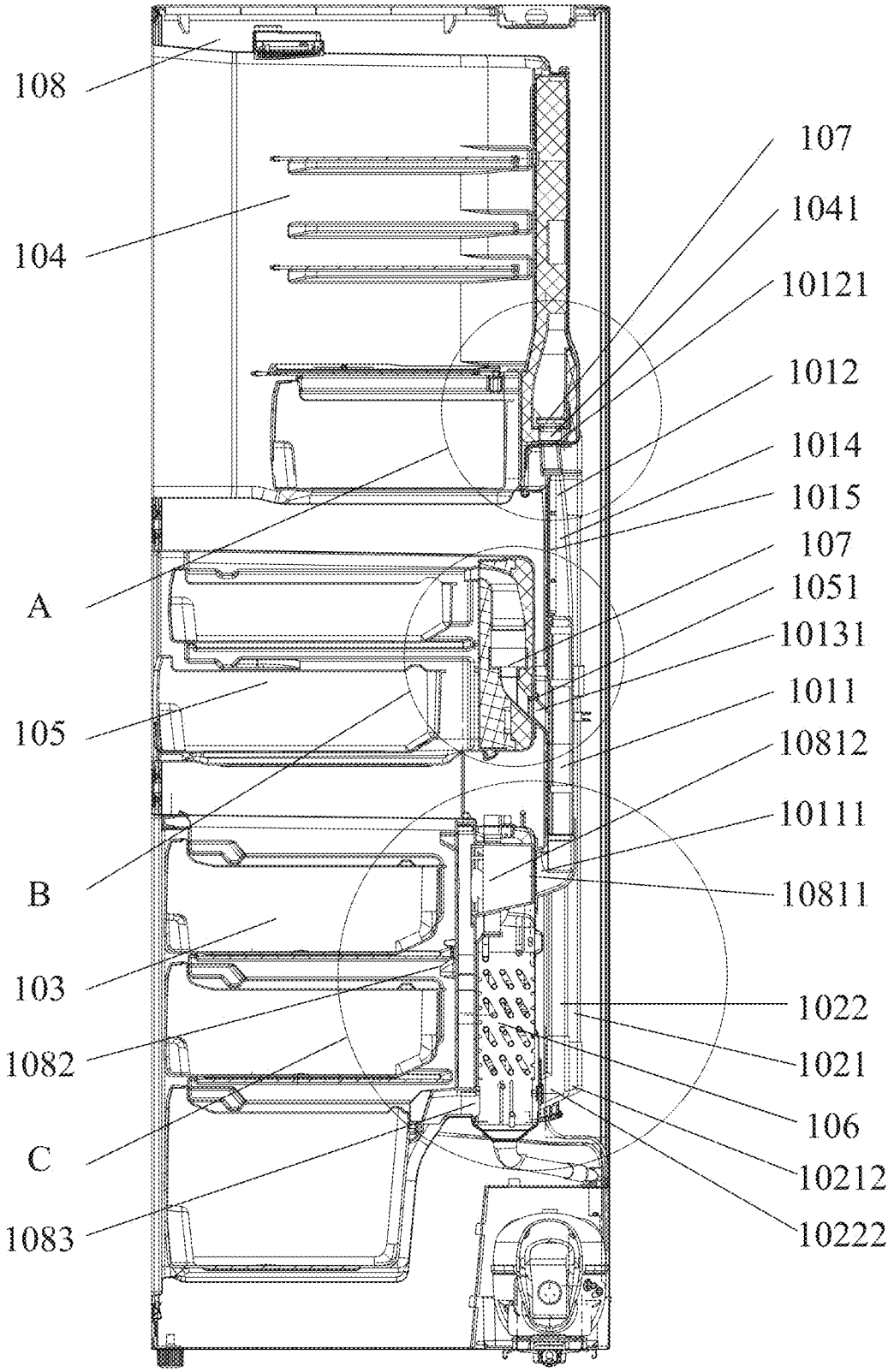
FIG. 5 is cross sectional view of the air-cooled refrigerator shown in FIG. 1.
Figure 6:
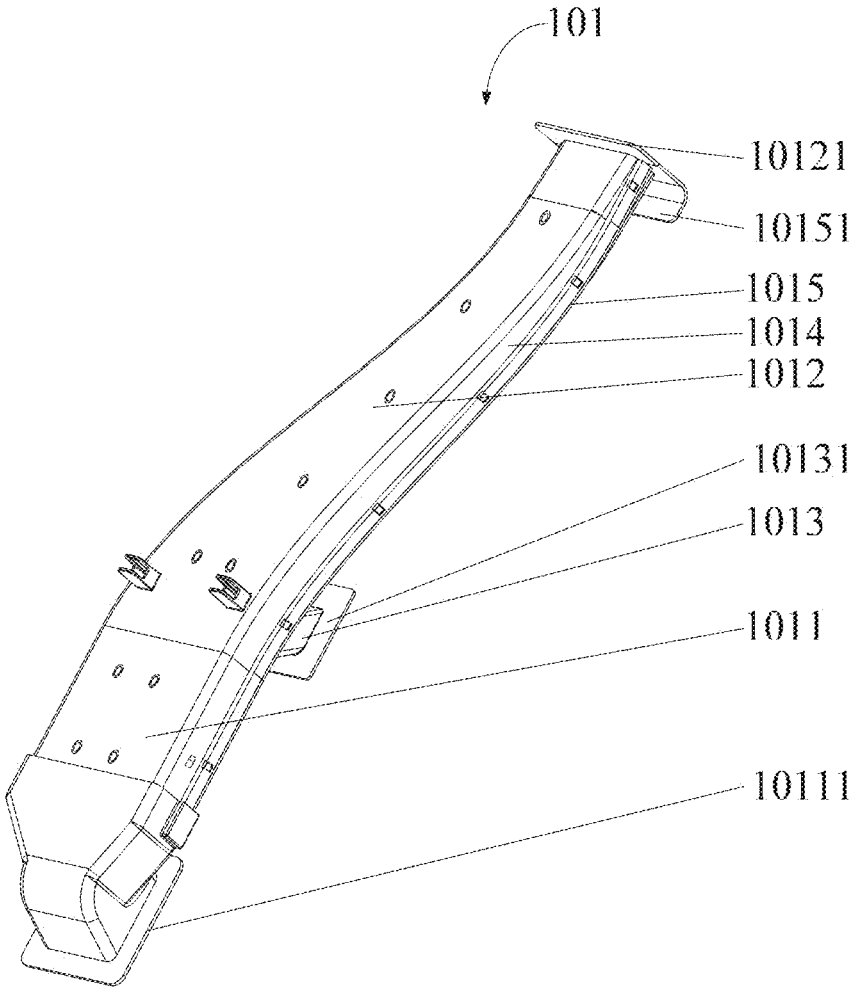
FIG. 6 is a perspective view of an air inlet duct of the air-cooled refrigerator shown in FIG. 3.
Figure 7:
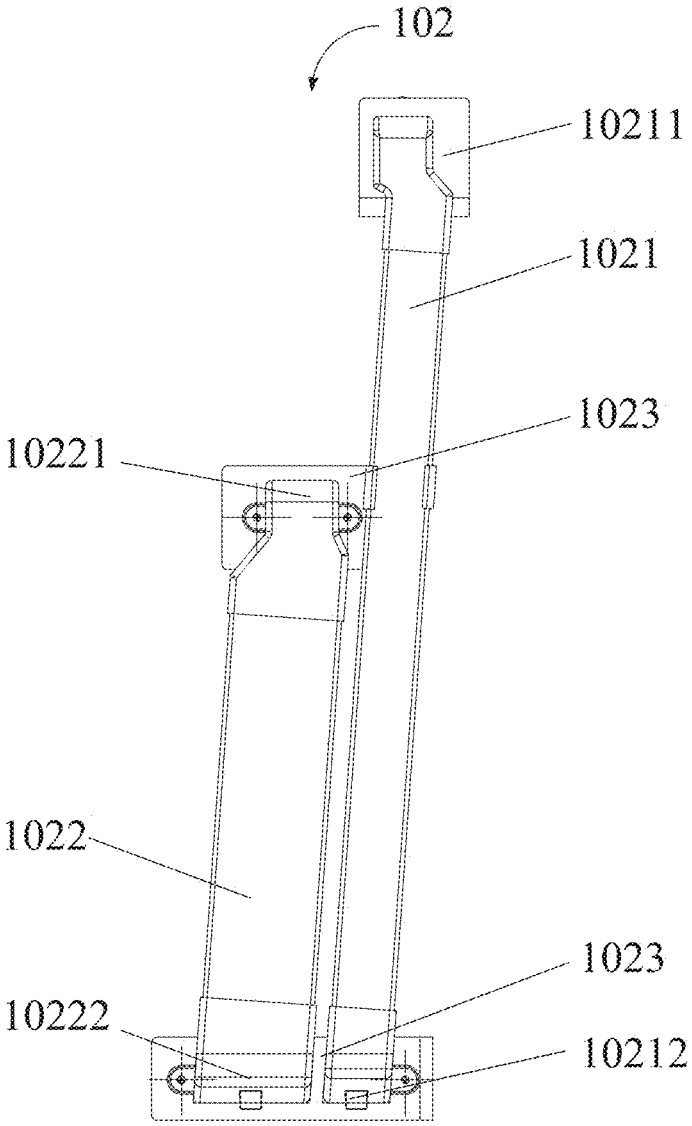
FIG. 7 is a perspective view of an air return duct of the air-cooled refrigerator shown in FIG. 3.
Figure 8:
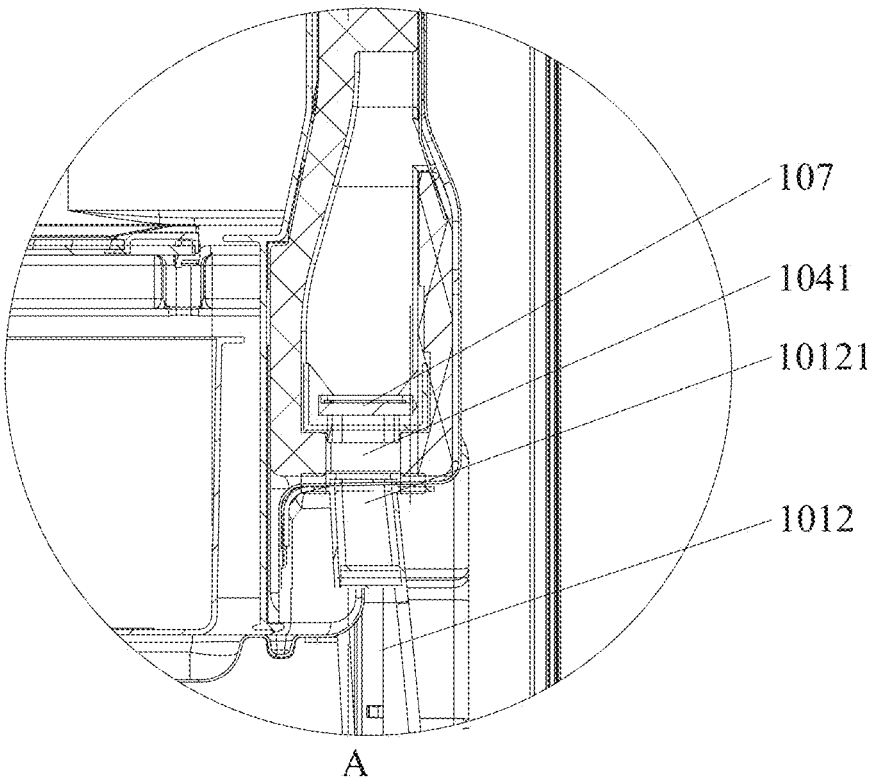
FIG. 8 is a partially schematic view of portion A of the air-cooled refrigerator shown in FIG. 5.
Figure 9:
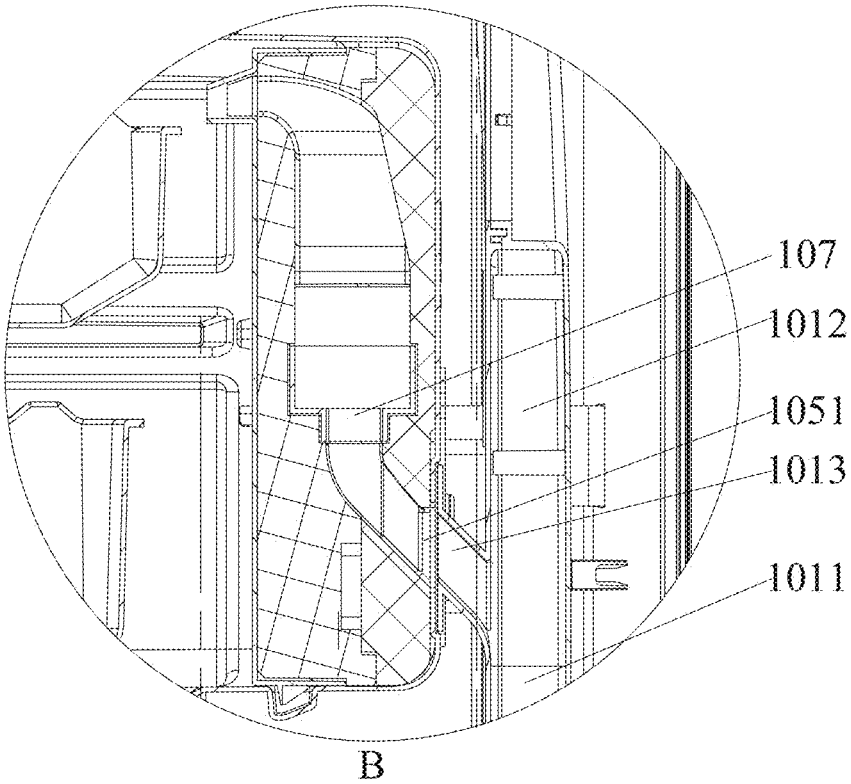
FIG. 9 is a partially schematic view of portion B of the air-cooled refrigerator shown in FIG. 5.
Figure 10:
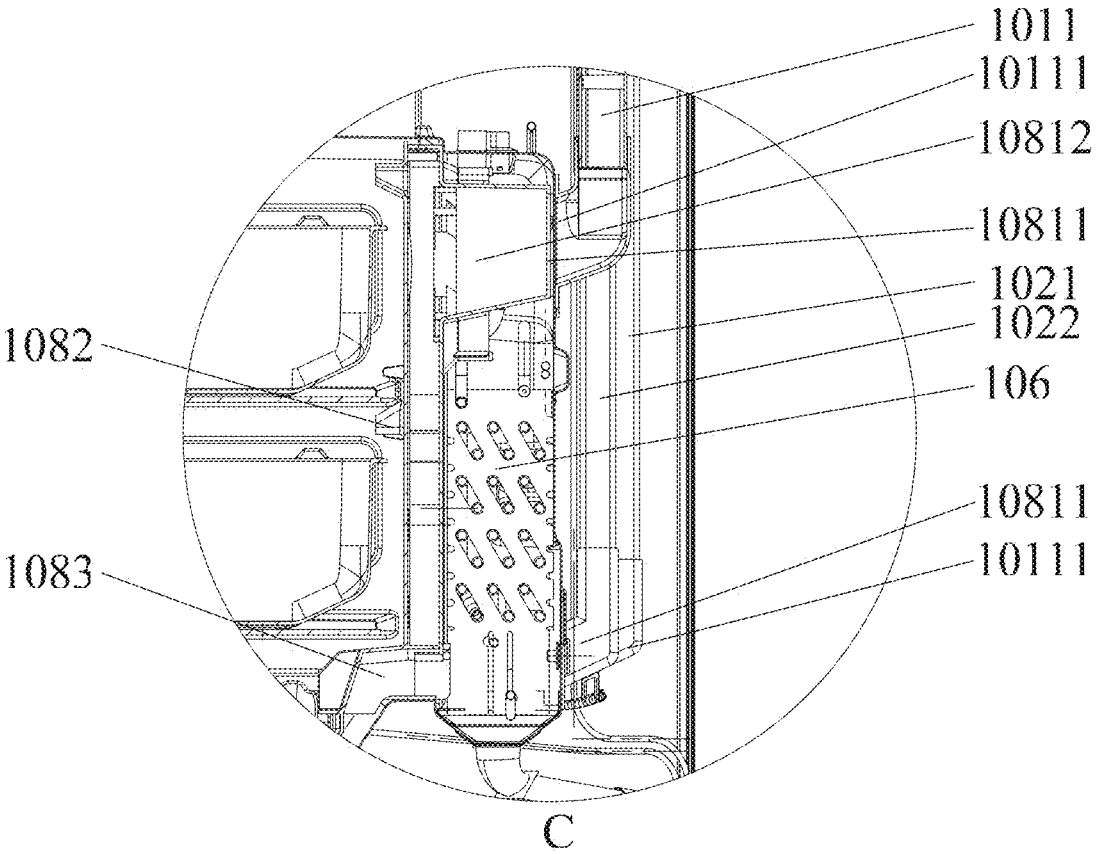
FIG. 10 is a partially schematic view of portion C of the air-cooled refrigerator shown in FIG. 5.

Specifically, as shown in FIG. 3, FIG. 4 and FIG. 7, the air return duct 102 further includes a fixing plate 1023, the fixing plate 1023 is provided with a through hole, the refrigeration compartment air return duct 1021 and the temperature changeable compartment air return duct 1022 are fixedly connected together through the fixing plate 1023, the rear wall of the refrigerator body 108 is provided with a threaded hole matched with the through hole, and the fixing plate 1023 is threadedly connected to the rear wall of the refrigerator body 108.

The refrigeration compartment air return duct and the temperature changeable compartment air return duct are fixedly connected together through the fixing plate, enabling the connection between the refrigeration compartment air return duct and the temperature changeable compartment air return duct to be more stable and more reliable during use, and facilitating the production and assembling.

Specifically, as shown in FIGS. 4-7, both the air inlet duct 101 and the air return duct 102 are made of polypropylene, and the air inlet duct 101 is adhered to the rear wall of the refrigerator body 108 by an adhesive tape.

Both the air inlet duct and the air return duct are made of polypropylene, differing from an EPS foam air duct of the traditional air-cooled refrigerator, the polypropylene air duct has a better sealing property, a simpler structure and is not easy to damage during transportation, and has a lower cost.

As shown in FIGS. 1-5, an air-cooled refrigerator according to some embodiments of the present disclosure is provided, the air inlet duct conveys the cold air to the refrigeration compartment and the temperature changeable compartment simultaneously, and the cooling rate will be higher. The electric air doors may accurately control the volume of air entering the refrigeration compartment and the temperature changeable compartment, thereby enabling the temperature control of the refrigeration compartment and the temperature changeable compartment to be more accurate, therefore the air-cooled refrigerator has more advantages over the traditional air-cooled refrigerator, being helpful for improving the sales volume of the air-cooled refrigerator.

From the above, the air inlet duct in the air-cooled refrigerator may be connected with the refrigeration compartment, the temperature changeable compartment and the outlet of the finned evaporator, and the cold air having passed through the finned evaporator will be conveyed into the refrigeration compartment and the temperature changeable compartment through the refrigeration compartment air inlet duct and the temperature changeable compartment air inlet duct, the air inlet duct has a simple structure, and compared with an air inlet duct in the prior art, the occupation space is smaller and the production cost is lower, and an electric switching valve is not needed to switch a refrigerant, so the cooling rate is higher, the structure is simpler, and the production cost is lower. In addition, the refrigeration compartment air return duct and the temperature changeable compartment air return duct are spaced apart in the lower portion of the finned evaporator, which may effectively prevent the two kinds of return air having a larger temperature and humidity difference from being mixed, so that the finned evaporator, the refrigeration compartment air return duct and the temperature changeable compartment air return duct will not be frosted up, saving the energy consumption for defrosting and enabling the energy consumption of the air-cooled refrigerator to be lower. In addition, the electric air doors may adjust the volume of air entering the refrigeration compartment and the temperature changeable compartment independently, enabling the air-cooled refrigerator to precisely control the temperature of the refrigeration compartment and the temperature changeable compartment. Moreover the air-cooled refrigerator provided with the air inlet duct and the air return duct is easy for production and assembly, thereby enabling the production efficiency of the air-cooled refrigerator to be higher. Moreover the structure of the air-cooled refrigerator is simpler, enabling the production cost of the air-cooled refrigerator to be lower, thereby effectively improving the economic benefits of the products. In addition, the finned evaporator of the air-cooled refrigerator does not need defrosting, thus the energy consumption is lower, and the air inlet duct conveys the cold air to the refrigeration compartment and the temperature changeable compartment simultaneously, the cooling rate will be higher, the electric air doors may accurately control the volume of air entering the refrigeration compartment and the temperature changeable compartment, thereby enabling the temperature control of the refrigeration compartment and the temperature changeable compartment to be more accurate. Therefore the air-cooled refrigerator has more advantages over the traditional air-cooled refrigerator, being helpful for improving the sales volume of the air-cooled refrigerator.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. An air-cooled refrigerator comprising:

a freezer compartment;

a refrigeration compartment;

a temperature changeable compartment;

a finned evaporator;

an air inlet duct mounted to a rear wall of a refrigerator body;

wherein the air inlet duct comprises a main air duct, a refrigeration compartment air inlet duct and a temperature changeable compartment air inlet duct;

wherein the main air duct has a first end directly connected to the refrigeration compartment air inlet duct and indirectly connected to the temperature changeable compartment air inlet duct, and the main air duct has a second end connected to an outlet of the finned evaporator;

wherein the finned evaporator provides cold air to the refrigeration compartment and the temperature changeable compartment through the air inlet duct, such that the cold air flows successively from the main air duct to the refrigeration compartment air inlet duct, and from the refrigeration compartment air inlet duct successively to the temperature changeable compartment air inlet duct;

wherein the finned evaporator further provides the cold air to the freezer compartment;

an air return duct mounted to the rear wall of the refrigerator body;

wherein the air return duct comprises a refrigeration compartment air return duct and a temperature changeable compartment air return duct;

wherein the refrigeration compartment air return duct guides return air in the refrigeration compartment into a lower portion of the finned evaporator, the temperature changeable compartment air return duct guides returning air in the temperature changeable compartment into the lower portion of the finned evaporator; and wherein an outlet of the refrigeration compartment air return duct and an outlet of the temperature changeable compartment air return duct are spaced apart in the lower portion of the finned evaporator;

a first electric air door disposed in the refrigeration compartment air inlet duct, the first electric air door capable of adjusting a volume of air entering the refrigeration compartment independently; and a second electric air door disposed in the temperature changeable compartment air inlet duct, the second electric air door capable of adjusting a volume of air entering the temperature changeable compartment independently.

2. The air-cooled refrigerator according to claim 1, wherein:

the finned evaporator is mounted to a lower portion of a rear wall of a refrigeration box, and both the refrigeration compartment air return duct and the temperature changeable compartment air return duct are connected to a lower end of the rear wall of the refrigeration box;

each of the refrigeration compartment air return duct and the temperature changeable compartment air return duct comprise ends connected to the rear wall of the refrigeration box, wherein a distance between the refrigeration compartment air return duct and the temperature changeable compartment air return duct is greater than or equal to 10 mm;

an upper end of the rear wall of the refrigeration box is provided with a freezer compartment air inlet duct communicated with the freezer compartment, the lower end of the rear wall of the refrigeration box is further provided with a freezer compartment air return duct communicated with the freezer compartment; and the second end of the main air duct is communicated with the upper end of the rear wall of the refrigeration box, and a height of the main air duct is greater than a height of the freezer compartment air inlet duct.

3. The air-cooled refrigerator according to claim 2, wherein the refrigeration compartment air inlet duct is provided with a refrigeration compartment air inlet and the temperature changeable compartment air inlet duct is provided with a temperature changeable compartment air inlet;

a rear wall of the refrigeration compartment and a rear wall of the temperature changeable compartment are respectively provided with a refrigeration compartment air duct connecting position and a temperature changeable compartment air duct connecting position fitted with the refrigeration compartment air inlet and the temperature changeable compartment air inlet respectively, the refrigeration compartment air inlet and the temperature changeable compartment air inlet are connected to the refrigeration compartment air duct connecting position and the temperature changeable compartment air duct connecting position respectively;

both the refrigeration compartment air duct connecting position and the temperature changeable compartment air duct connecting position are provided with the electric air doors therein.

4. The air-cooled refrigerator according to claim 3, wherein the ends of the refrigeration compartment air return duct include a first end configured to be a refrigeration compartment air return port and a second end configured to be a first freezer air return port, wherein the refrigeration compartment air return port is connected with the refrigeration compartment, and the first freezer air return port is connected with the refrigeration box;

wherein the ends of the temperature changeable compartment air return duct include a first end configured to be a second freezer air return port; and a second end configured to be a temperature changeable compartment air return port, wherein the second freezer air return port is connected with the refrigeration box, and the temperature changeable compartment air return port is connected with the temperature changeable compartment; and wherein both the first freezer air return port and the second freezer air return port are connected with the lower end of the rear wall of the refrigeration box, and a distance between the first freezer air return port and the second freezer air return port is 10 mm.

5. The air-cooled refrigerator according to claim 4, wherein the main air duct is provided with a main air duct air inlet, the upper end of the rear wall of the refrigeration box is provided with a main air duct connecting position connected to the main air duct air inlet, the main air duct connecting position is communicated with the freezer compartment air inlet duct, and a height of the main air duct connecting position is greater than a height of the freezer compartment air inlet duct; and wherein the main air duct connecting position is further provided with a fan motor therein, wherein when the fan motor rotates, the cold air cooled by the finned evaporator is blown into the main air duct and part of the cold air is blown into the freezer compartment through the freezer compartment air inlet duct.

6. The air-cooled refrigerator according to claim 1, wherein a sectional area of the refrigeration compartment air return duct is 1-1.2 times as much as a sectional area of the refrigeration compartment air inlet duct, and a sectional area of the temperature changeable compartment air return duct is 1-1.2 times as much as a sectional area of the temperature changeable compartment air inlet duct.

7. The air-cooled refrigerator according to claim 6, wherein the sectional area of the refrigeration compartment air return duct is 1.2 times as much as the sectional area of the refrigeration compartment air inlet duct, and the sectional area of the temperature changeable compartment air return duct is 1.2 times as much as the sectional area of the temperature changeable compartment air inlet duct.

8. The air-cooled refrigerator according to claim 1, wherein the air inlet duct comprises:

an air inlet duct upper cover and an air inlet duct lower cover, wherein the air inlet duct upper cover and the air inlet duct lower cover are provided with a snap and a snap position respectively, the air inlet duct upper cover and the air inlet duct lower cover are connected with each other through snap-fit between the snap and the snap position, forming the air inlet duct;

the air inlet duct lower cover is provided with an air duct snap, the rear wall of the refrigerator body is provided with an air duct snap position, the air inlet duct is connected to the rear wall of the refrigerator body through snap-fit between the air duct snap and the air duct snap position on the refrigeration compartment air inlet duct.

9. The air-cooled refrigerator according to claim 1, wherein the air return duct further comprises:

a fixing plate, wherein the fixing plate is provided with a through hole, the refrigeration compartment air return duct and the temperature changeable compartment air return duct are fixedly connected together through the fixing plate, the rear wall of the refrigerator body is provided with a threaded hole matched with the through hole, and the fixing plate is threadedly connected to the rear wall of the refrigerator body.

10. The air-cooled refrigerator according to claim 9, wherein both the air inlet duct and the air return duct are made of polypropylene, and the air inlet duct is adhered to the rear wall of the refrigerator body by an adhesive tape.

11. The air-cooled refrigerator according to claim 2, wherein a sectional area of the refrigeration compartment air return duct is 1-1.2 times as much as a sectional area of the refrigeration compartment air inlet duct, and a sectional area of the temperature changeable compartment air return duct is 1-1.2 times as much as a sectional area of the temperature changeable compartment air inlet duct.

12. The air-cooled refrigerator according to claim 3, wherein a sectional area of the refrigeration compartment air return duct is 1-1.2 times as much as a sectional area of the refrigeration compartment air inlet duct, and a sectional area of the temperature changeable compartment air return duct is 1-1.2 times as much as a sectional area of the temperature changeable compartment air inlet duct.

13. The air-cooled refrigerator according to claim 4, wherein a sectional area of the refrigeration compartment air return duct is 1-1.2 times as much as a sectional area of the refrigeration compartment air inlet duct, and a sectional area of the temperature changeable compartment air return duct is 1-1.2 times as much as a sectional area of the temperature changeable compartment air inlet duct.

14. The air-cooled refrigerator according to claim 5, wherein a sectional area of the refrigeration compartment air return duct is 1-1.2 times as much as a sectional area of the refrigeration compartment air inlet duct, and a sectional area of the temperature changeable compartment air return duct is 1-1.2 times as much as a sectional area of the temperature changeable compartment air inlet duct.

15. The air-cooled refrigerator according to claim 2, wherein the air inlet duct comprises:

an air inlet duct upper cover and an air inlet duct lower cover, wherein the air inlet duct upper cover and the air inlet duct lower cover are provided with a snap and a snap position respectively, the air inlet duct upper cover and the air inlet duct lower cover are connected with each other through snap-fit between the snap and the snap position, forming the air inlet duct;

the air inlet duct lower cover is provided with an air duct snap, the rear wall of the refrigerator body is provided with an air duct snap position, the air inlet duct is connected to the rear wall of the refrigerator body through snap-fit between the air duct snap and the air duct snap position on the refrigeration compartment air inlet duct.

16. The air-cooled refrigerator according to claim 3, wherein the air inlet duct comprises:

an air inlet duct upper cover and an air inlet duct lower cover, wherein the air inlet duct upper cover and the air inlet duct lower cover are provided with a snap and a snap position respectively, the air inlet duct upper cover and the air inlet duct lower cover are connected with each other through snap-fit between the snap and the snap position, forming the air inlet duct;

the air inlet duct lower cover is provided with an air duct snap, the rear wall of the refrigerator body is provided with an air duct snap position, the air inlet duct is connected to the rear wall of the refrigerator body through snap-fit between the air duct snap and the air duct snap position on the refrigeration compartment air inlet duct.

17. The air-cooled refrigerator according to claim 4, wherein the air inlet duct comprises:

an air inlet duct upper cover and an air inlet duct lower cover, wherein the air inlet duct upper cover and the air inlet duct lower cover are provided with a snap and a snap position respectively, the air inlet duct upper cover and the air inlet duct lower cover are connected with each other through snap-fit between the snap and the snap position, forming the air inlet duct;

the air inlet duct lower cover is provided with an air duct snap, the rear wall of the refrigerator body is provided with an air duct snap position, the air inlet duct is connected to the rear wall of the refrigerator body through snap-fit between the air duct snap and the air duct snap position on the refrigeration compartment air inlet duct.

18. The air-cooled refrigerator according to claim 5, wherein the air inlet duct comprises:

an air inlet duct upper cover and an air inlet duct lower cover, wherein the air inlet duct upper cover and the air inlet duct lower cover are provided with a snap and a snap position respectively, the air inlet duct upper cover and the air inlet duct lower cover are connected with each other through snap-fit between the snap and the snap position, forming the air inlet duct;

the air inlet duct lower cover is provided with an air duct snap, the rear wall of the refrigerator body is provided with an air duct snap position, the air inlet duct is connected to the rear wall of the refrigerator body through snap-fit between the air duct snap and the air duct snap position on the refrigeration compartment air inlet duct.

19. The air-cooled refrigerator according to claim 2, wherein the air return duct further comprises:

a fixing plate, wherein the fixing plate is provided with a through hole, the refrigeration compartment air return duct and the temperature changeable compartment air return duct are fixedly connected together through the fixing plate, the rear wall of the refrigerator body is provided with a threaded hole matched with the through hole, and the fixing plate is threadedly connected to the rear wall of the refrigerator body.

20. The air-cooled refrigerator according to claim 3, wherein the air return duct further comprises:

a fixing plate, wherein the fixing plate is provided with a through hole, the refrigeration compartment air return duct and the temperature changeable compartment air return duct are fixedly connected together through the fixing plate, the rear wall of the refrigerator body is provided with a threaded hole matched with the through hole, and the fixing plate is threadedly connected to the rear wall of the refrigerator body.

21. The air-cooled refrigerator according to claim 1, wherein the temperature changeable compartment air inlet duct is positioned between the temperature changeable compartment and the refrigerator compartment air inlet duct.

22. The air-cooled refrigerator according to claim 1, wherein the temperature changeable compartment air inlet duct, the refrigeration compartment air inlet duct, and the main air duct form a single continuous chamber.

* * * * *